US005310492A

United States Patent [19]

Seiki et al.

[11] Patent Number: 5,310,492

[45] Date of Patent: May 10, 1994

[54] REFRIGERATING MACHINE OIL COMPOSITION

[75] Inventors: Hiromichi Seiki; Masato Kaneko; Hideo Kanamori, all of Ichihara, Japan

[73] Assignee: Idemitsu Kosan Co., Ltd., Tokyo, Japan

[21] Appl. No.: 859,100

[22] Filed: Mar. 27, 1992

[30] Foreign Application Priority Data

Mar. 29, 1991 [JP] Japan ..... 3-089070

[51] Int. Cl.[5] ..... C09K 5/00; C10M 107/34; C10M 119/00

[52] U.S. Cl. ..... 252/68; 252/41; 252/52 A; 252/58

[58] Field of Search ..... 252/38, 41, 52 A, 58, 252/68

[56] References Cited

U.S. PATENT DOCUMENTS

| | | | |
|---|---|---|---|
| 1,920,845 | 8/1933 | Dantsizen | 62/178 |
| 2,212,826 | 8/1940 | Downing et al. | 252/68 |
| 2,523,863 | 9/1950 | Cook et al. | 252/68 |
| 3,129,185 | 4/1964 | Rizzuti | 252/68 |
| 4,755,316 | 7/1988 | Magid et al. | 252/52 A |
| 4,948,525 | 8/1990 | Sasaki et al. | 252/52 A |

FOREIGN PATENT DOCUMENTS

| | | |
|---|---|---|
| 0397037 | 11/1990 | European Pat. Off. . |
| 90/12849 | 11/1990 | PCT Int'l Appl. . |

*Primary Examiner*—Prince Willis, Jr.
*Assistant Examiner*—J. Silbermann
*Attorney, Agent, or Firm*—Antonelli, Terry, Stout & Kraus

[57] ABSTRACT

Disclosed is a refrigerating machine oil composition, comprising a base oil and a metal salt of a carboxylic aid having from 3 to 60 carbon atoms.

The refrigerating machine oil (lubricating oil) of the present invention is very well miscible with hydrogen-containing Flon refrigerants such as Flon 134a, achieves an excellent lubrication performance and is good enough to bring forth marked improvement of a wear resistance, particularly a wear resistance of aluminum-steel friction surfaces.

5 Claims, No Drawings

REFRIGERATING MACHINE OIL COMPOSITION

BACKGROUND OF THE INVENTION

1. Field of the Invention

The present invention relates to a refrigerating machine oil composition, more particularly to a refrigerating machine oil composition having good miscibility (or compatibility) with a hydrogen-containing Flon compound (fluoroalkane) such as 1,1,1,2-tetrafluoroethane (hereinafter referred to as "Flon 134a") capable of replacing conventional Flon compounds such as dichlorodifluoromethane (hereinafter referred as "Flon 12") which have been blamed for environmental pollution, and also having an excellent wear resistance, lubrication performance and stability in a Flon atmosphere.

2. Description of the Related Arts

In recent years, there have been reported that polyoxyalkylene glycol derivatives are highly miscible with hydrogen-containing Flon refrigerants such as Flon 134a which do not cause environmental pollution and will be useful as a lubricating oil in refrigerators using these hydrogen-containing Flon refrigerants (Specification of U.S. Pat. No. 4,755,316).

However, the polyoxyalkylene glycol derivatives have also been found to be a serious problem when used in connection with refrigerating machine such as automobile air conditioners and refrigerators because the compounds have a low wear resistance and are responsible for increases in the wear loss of friction surfaces between aluminum part and steel part (aluminum-steel friction surfaces) of the refrigerating machine in an atmosphere of said refrigerants. These friction surfaces are an important element in lubrication, consisting of the contact surface between the piston and the piston shoe or between swash plate and the shoe portion in the case of a reciprocating compressor, or consisting of the contact surface between the vane and the housing portion in the case of a rotary compressor.

Various different improvers of wear resistance have been well-known, but there has been no known means to prevent the wear loss of the aluminum-steel friction surfaces without adversely affecting the stability of the surfaces under the special condition of a Flon atmosphere.

The present inventors have made intensive researches and investigations with a view to developing a refrigerating machine oil (a lubricating oil) which has high miscibility with hydrogen-containing Flon refrigerant such as Flon 134a, is excellent in the lubrication performance and is effective for the improvement of the wear resistance, especially the wear resistance of the aluminum-steel friction surfaces. As the result, it has been found that the above-mentioned objects can be achieved by mixing a specific carboxylic acid metal salt with a specific base oil. The present invention has been completed on the basis of this finding.

SUMMARY OF THE INVENTION

An object of the present invention is to provide a refrigerating machine oil composition having good miscibility with a hydrogen-containing Flon compound.

Another object of the present invention is to provide a refrigerating machine oil composition having an excellent wear resistance, lubrication performance and stability in a Flon atmosphere.

The present invention provides a refrigerating machine oil composition comprising a base oil and a metal salt of a carboxylic acid having from 3 to 60 carbon atoms.

DESCRIPTION OF THE PREFERRED EMBODIMENTS

The base oil to be used in the refrigerating machine oil composition of the present invention is a commonly used as refrigerating machine oil, and though its kind and property are not particularly limited, it is preferably a mineral and/or synthetic oil having a kinematic viscosity at 40° C. of 5 to 1000 cSt, more preferably 10 to 500 cSt.

Further, relative to this base oil, the pour point which is an index of fluidity at the low temperature region, is not particularly limited but preferably is −10° C. or lower.

The above-mentioned base oil can be appropriately selected from various different mineral and/or synthetic oils according to the purpose of use. Examples of preferable mineral oil include paraffinic mineral oil, naphthenic mineral oil and the like, while examples of preferable synthetic oil include polyoxyalkylene derivative, ester compound (particularly polyester compound), alkyl benzene, alkyl naphthalene, poly-α-olefin and the like. Among them, the polyoxyalkylene derivative and the polyester compound are most preferable. The above-mentioned polyoxyalkylene derivative includes polyoxyalkylene glycol, its monoalkyl ether (that having alkyl ether formed at a terminal of a molecule), and its dialkyl ether (that having alkyl ethers formed at the both terminals of a molecule). As the oxyalkylene unit, oxyethylene, oxypropylene, oxybutylene and a mixture of two or more of them (for example, a mixture of oxyethylene and oxypropylene) can be mentioned.

There have been made available various different polyester compounds and an appropriate one is selected from them according to the purpose of use. Examples of preferable polyester compound include the reaction products mentioned in (I) to (V) below:

(I) a reaction product of (1) a polybasic carboxylic acid or derivative thereof, (2) a polyhydric alcohol or derivative thereof and (3) a monobasic fatty acid or derivative thereof.

(II) a reaction product of (1) a polybasic carboxylic acid or derivative thereof, (2) a polyhydric alcohol or derivative thereof and (4) a monohydric aliphatic alcohol or derivative thereof.

(III) a reaction product (or an equivalent reaction product) of (2) a polyhydric alcohol or derivative thereof and (3) a monobasic fatty acid or derivative thereof.

(IV) a reaction product of (4) a monohydric aliphatic alcohol or derivative thereof and (1) a polybasic carboxylic acid or derivative thereof.

(V) a reaction product of (1) a polybasic carboxylic acid or derivative thereof and (2) a polyhydric alcohol or derivative thereof.

The present invention is characterized in that above-mentioned base oil is mixed with a metal salt of a carboxylic acid. The carboxylic acid metal salt to be used herein is a metal salt of a carboxylic acid having from 3 to 60 carbon atoms, preferably from 6 to 30 carbon atoms and more preferably from 12 to 30 carbon atoms. Further, the metal salt of a dimeric acid or trimeric acid of said fatty acid and a dicarboxylic acid having from 3 to 30 carbon atoms can be mentioned as well. Among them, the metal salt of a fatty acid having from 12 to 30 carbon atoms or a dicarboxylic acid having from 3 to 30 carbon atoms is particularly preferable.

On the other hand, the metal to be used for said metal salt is preferably an alkali metal or an alkaline earth metal and particularly an alkali metal salt is most preferable.

As mentioned above, there have been a variety of carboxylic acids forming the carboxylic acid metal salts to be added into said base oils, including saturated aliphatic monocarboxylic acid, unsaturated aliphatic carboxylic acid, aliphatic dicarboxylic acid and aromatic carboxylic acid and the like. Specific examples of saturated aliphatic monocarboxylic acid include a fatty acid of straight chain such as caproic acid; caprylic acid; capric acid; lauric acid; myristic acid; palmitic acid; stearic acid; arachic acid; cerotic acid; and lacceric acid or a fatty acid of branched chain such as isopentanoic acid; 2-methylpentanoic acid; 2-methylbutanoic acid; 2,2-dimethylbutanoic acid; 2-methylhexanoic acid; 5-methylhexanoic acid; 2,2-dimethylheptanoic acid; 2-ethyl-2-methylbutanoic acid; 2-ethylhexanoic acid; dimethylhexanoic acid; 2-n-propylpentanoic acid; 3,5,5-trimethylhexanoic acid; dimethyloctanoic acid; isotridecanoic acid; isomyristic acid; isostearic acid; isoarachic acid; and isohexanoic acid and the like. Examples of unsaturated aliphatic carboxylic acid include palmitoleic acid; oleic acid; elaidic acid; linolic acid; and linolenic acid, and also include unsaturated hydroxy acid such as ricinolic acid. Further, examples of aliphatic dicarboxylic acid include adipic acid; azelaic acid; and sebacic acid, while those of aromatic carboxylic acid include benzoic acid, phthalic acid, trimellitic acid; and pyromellitic acid. Alicyclic fatty acid such as naphthenic acid can be used as well. A combination of two or more of above-mentioned carboxylic acids can also be used according to the purpose of use.

The metals to combine with above-mentioned carboxylic acids to form metal salts are not particularly limited but a variety of them can be used in the present invention, including alkali metals such as lithium, potassium and sodium, alkaline earth metals such as magnesium, calcium and strontium and other metals such as zinc, nickel and aluminum. In the present invention, the number of metal to be bonded to a carboxylic acid is not limited to one entity alone but two or more metals can be bonded to a carboxylic acid appropriately according to the purpose of use. The metal to be used herein preferably is an alkali metal or an alkali earth metal and particularly the alkali metal is most preferable.

A metal salt consisting of above-mentioned carboxylic acid and metal can be incorporated into the refrigerating machine oil composition of the present invention in any amount appropriate to the purpose of use but preferably in an amount of 0.001 to 10% by weight, more preferably 0.005 to 3% by weight, based on the total of said composition. When the amount of the metal salt is less than 0.001% by weight, the sufficient wear resistance is not obtained and when it is more than 10% by weight, the stability of said composition is decreased.

The composition of the present invention can be prepared by adding said carboxylic acid metal salt to said base oil using various different methods. For improving the solubility of the carboxylic acid metal salt in said base oil, however, it is effective to prepare the composition according to the following method; provided that it is should be noted that said under-mentioned method is only one of many methods for preparing said composition of the present invention.

At first, the carboxylic acid metal salt is dissolved previously by injecting carboxylic acid and alkali hydroxide into an solvent, allowing the mixture to react at room temperature or with heating and forming the carboxylic acid metal salt in a state in which it is dissolved or dispersed in said solvent. Next, the carboxylic acid metal salt dissolved and dispersed in said solvent is added as it is, mixed and dispersed into the base oil. The desired composition can be efficiently obtained by dissolving or dispersing said carboxylic acid metal salt in a solvent ahead of time and then adding so obtained metal salt solution or dispersed liquid to the base oil.

Various different compounds can be used as the solvent herein and examples of monohydric alcohol as the solvent include n-butyl alcohol; iso-butyl alcohol; sec-butyl alcohol; t-butyl alcohol; n-amyl alcohol; iso-amyl alcohol; sec-amyl alcohol; n-hexyl alcohol; methylamyl alcohol; ethylbutyl alcohol, heptyl alcohol; n-octyl alcohol; secoctyl alcohol; 2-ethylhexyl alcohol; iso-octyl alcohol; n-nonyl alcohol; 2,6-dimethyl-4-heptanol; n-decyl alcohol; and cyclohexanol, while examples of glycol and polyhydric alcohol include ethylene glycol; diethylene glycol; triethylene glycol; tetraethylene glycol; propylene glycol; dipropylene glycol; 1,4-butylene glycol; 2,3-butylene glycol; hexylene glycol, octylene glycol; and glycerin. Examples of cellosolve include ethylene glycol monomethyl ether; ethylene glycol ethyl ether; ethylene glycol diethyl ether; ethylene glycol butyl ether; ethylene glycol dibutyl ether; ethylene glycol phenyl ether; ethylene glycol benzyl ether; ethylene glycol ethylhexyl ether; diethylene glycol methyl ether; diethylene glycol ethyl ether; diethylene glycol diethyl ether; diethylene glycol butyl ether; diethylene glycol dibutyl ether; propylene glycol methyl ether; propylene glycol ethyl ether; propylene glycol butyl ether; dipropylene glycol methyl ether; dipropylene glycol ethyl ether; tripropylene glycol methyl ether; tetraethylene glycol dimethyl ether; and tetraethylene glycol dibutyl ether. Further, examples of crown ether include benzo-15-crown-5, benzo-12-crown-4, benzo-15-crown-5, benzo-18-crown-6 and dibenzo-18-crown-6, those of ketone include ethyl butyl ketone, dipropyl ketone, methylamyl ketone, methylhexyl ketone and diisobutyl ketone and those of fatty acid include said fatty acids having from 6 to 30 carbon atoms.

The concentration of said metal salt to be dissolved or dispersed in above-mentioned solvents is not particularly limited but can appropriately be chosen depending upon involved circumstances.

The composition of the present invention is prepared by adding a carboxylic acid metal salt to a base oil. If necessary, various different additives that have been used in conventional lubricating oils such as load carrying additives (extreme pressure agent, oiliness agent, etc.), chlorine capturing agent, antioxidant, metal deactivator, defoaming agent, detergent-dispersant, viscosity index improver, pour point depressant, anti-rust agent, corrosion inhibitor can be optionally incorporated to the composition.

Said load carrying additives include organic sulfur compounds such as monosulfides, polysulfides, sulfoxides, sulfones, thiosulfonates, sulfurized oils and fats, thiocarbonates, thiophenes, thiazoles and methanesulfonic esters; phosphoric esters such as phosphoric monoesters, phosphoric diesters and phosphoric triesters; phosphorous esters such as phosphorous monoesters, phosphorous diesters and phosphorous triesters; thiophosphoric esters such as thiophosphoric triesters;

fatty acids such as higher fatty acids, hydroxyaryl fatty acids and metallic soaps; fatty acid esters such as acrylate; chlorinated organic compounds such as chlorinated hydrocarbons and chlorinated carboxylic acid derivatives; fluorinated organic compounds such as fluorinated aliphatic carboxylic acids, fluorinated ethylene resins, fluorinated alkylpolysiloxanes and fluorinated graphites; alcohols such as higher alcohols; metallic compounds such as naphthenates (lead naphthenate), fatty acid salts (lead fatty acid salt), thiophosphates (zinc dialkyldithiophosphate), thiocarbamates, organomolybdenum compounds, organic tin compounds, organogermanium compounds and boric esters. Chlorine capturing agents include compounds having a glycidyl ether group, epoxidized fatty acid monoesters, epoxidized oils and fats and compounds having an epoxy cycloalkyl group. Antioxidants include phenols (2,6-ditertiary-butyl-p-cresol) and aromatic amines (α-naphthylamine). Metal deactivators include benzotriazole derivatives. Defoaming agents include silicone oil (dimethylpolysiloxane) and polymethacrylates. Detergent-dispersants include sulfonates, phenates and succinmides. Viscosity index improvers and pour point depressant agents include a polymethacrylate, polyisobutylene, ethylene-propylene copolymer and a hydrogenated product of styrene-diene copolymer.

Of said additives, particularly phosphoric esters and phosphonic esters are preferable. Though the amount of the additives is not particularly limited, it is ordinarily determined in the range of 0.1 to 5% by weight based on the total amount of said composition. The phosphoric ester compounds are divided into the alkyl phosphate compounds and the aryl phosphate compounds. The preferable phosphoric ester compounds (the phosphate compounds) are represented by the general formula $(R^1O)_3P=O$ (wherein $R^1$ represents a hydrocarbon group or chlorinated hydrocarbon group having 15 or more carbon atoms, especially an alkyl group (straight or branched chain and saturated or unsaturated) having from 8 to 20 carbon atoms, a phenyl group, a phenyl group substituted by $C_1$–$C_{12}$ alkyl group, chlorinated phenyl group or chlorinated alkylphenyl group, and $R^1$s may be the same or different). Their examples include tricresyl phosphate (TCP), triphenyl phosphate, triisopropylphenyl phosphate, trioctyl phosphate, trilauryl phosphate, tristearyl phosphate, trioleyl phosphate, diphenyloctyl phosphate, o-, m-, p-monochlorophenyl phosphate, dichlorophenyl phosphate, monochlorotolyl phosphate and dichlorotolyl phosphate, and particularly tricresyl phosphate is preferably used.

Further, the phosphorous acid ester compounds are divided into the alkyl phosphite compounds and the aryl phosphite compounds. The preferable phosphorous ester compounds (the phosphite compounds) are represented by the general formula $(R^2O)_3P$ (wherein $R^2$ represents a hydrogen atom or a hydrocarbon group having 15 or more carbon atoms, especially an alkyl group (straight or branched chain and saturated or unsaturated) having from 8 to 20 carbon atoms, a phenyl group, or a phenyl group substituted with $C_1$–$C_{12}$ alkyl group; $R^2$s may be the same or different; provided that two or more $R^2$s may not be allowed to represent hydrogen atoms simultaneously). Their specific examples include trioctyl phosphite, trilauryl phosphite, tristearyl phosphite, trioleyl phosphite, triphenyl phosphite, tricresyl phosphite, tris (nonylphenyl) phosphite, diphenyldecyl phosphite, dioctyl hydrogen phosphite, dilauryl hydrogen phosphite, dioleyl hydrogen phosphite and di(nonylphenyl) hydrogen phosphite.

The refrigerating machine oil composition of the present invention has a high stability, is excellent in the miscibility with a hydrogen-containing Flon refrigerant and the lubrication performance in an atomosphere of said Flon refrigerant such as Flon 134a, and functions effectively for improving the wear resistance of aluminum-steel friction surfaces. Another advantage is such that it is much less humidity-hygroscopic. Therefore, the refrigerating machine oil composition of the present invention can find its application as a lubricating oil in various different types of refrigerating machines using hydrogen-containing Flon refrigerants including compressor type refrigerating machines. Especially, said oil composition has good miscibility with hydrogen-containing Flon compounds (hydrogen-containing fluoroalkane), specifically including 1,1,2,2-tetrafluoroethane (Flon 134); 1,1-dichloro-2,2,2-trifluoroethane (Flon-123); 1-chloro-1,1-difluoroethane (Flon-142b); 1,1-difluoroethane (Flon-152a); chlorodifluoromethane (Flon-22) or trifluoromethane (Flon-23), besides said Flon 134a.

Therefore, it is expected that the refrigerating machine oil composition of the present invention will be useful as a lubricating oil in refrigerating machines such as refrigerators, coolers (especially, automobile air conditioners), heat pumps and the like using various different hydrogen-containing compounds as a refrigerant.

The present invention will now be described in detail below referring to the following examples but by no means is limited to those examples.

EXAMPLES 1 to 18

(1) Preparation of the solution of carboxylic acid metal salt

1. Dipropylene glycol as a solvent and oleic acid as a carboxylic acid were allowed to react with an alkali hydroxide of potassium hydroxide, sodium hydroxide and lithium hydroxide respectively to obtain a 30% by weight solution each of potassium oleate and sodium oleate (Examples 1 to 4, 7 to 10, 12, 13, 16 and 17).

2. Dipropylene glycol as a solvent and palmitic acid as a carboxylic acid were allowed to react with an alkali hydroxide of potassium hydroxide to obtain a 30% by weight solution of potassium palmitate (Examples 5, 6).

3. Dipropylene glycol as a solvent and sebacic acid as a carboxylic acid were allowed to react with an alkali hydroxide of potassium hydroxide to obtain a 30% by weight solution of potassium sebacate (Example 11).

4. Ethylene glycol as a solvent and oleic acid as a carboxylic acid were allowed to react with an alkali hydroxide of potassium hydroxide to obtain a 30% by weight solution of potassium oleate (Example 14).

5. Diethyl ether as a solvent and oleic acid as a carboxylic acid were allowed to react with an alkali hydroxide of lithium hydroxide to obtain a 30% by weight solution of lithium oleate (Example 18).

(2) Preparation of the composition

The metal salts dissolved and dispersed in said solutions were added as they were to each of the base oils shown in Table 1 and all the components were mixed and dispersed therein. Their amount was subjected to the adjustment so that the accurate quantity of each metal salt mentioned in Table 1 was actually incorporated in each base oil (the effective amount of addition) in order to obtain the desired refrigerating machine oil composition.

COMPARATIVE EXAMPLE 1

Substantially the same procedure as in Example 1 was repeated, except that potassium oleate used therein was replaced by chlorinated paraffin and that the amount was changed.

TABLE 1

| | Base oils |
|---|---|
| Example 1 | Polyoxypropylene glycol dimethyl ether*1 |
| Example 2 | Polyoxypropylene glycol dimethyl ether*1 |
| Example 3 | Polyoxypropylene glycol dimethyl ether*1 |
| Example 4 | Polyoxypropylene glycol dimethyl ether*1 |
| Example 5 | Polyoxypropylene glycol dimethyl ether*1 |
| Example 6 | Polyoxypropylene glycol dimethyl ether*1 |
| Example 7 | Polyoxypropylene glycol dimethyl ether*1 |
| Example 8 | Polyoxypropylene glycol dimethyl ether*2 |
| Example 9 | Polyoxyethylenepolyoxypropylene dimethyl ether*3 |
| Example 10 | Polyoxyethylenepolyoxypropylene dimethyl ether*3 |
| Example 11 | Polyoxyethylenepolyoxypropylene dimethyl ether*3 |
| Example 12 | Polyoxypropylene glycol monobutyl ether*4 |
| Example 13 | Polyoxypropylene glycol monobutyl ether*4 |
| Example 14 | Alkylbenzene*5 |
| Example 15 | Alkylbenzene*5 |
| Example 16 | Ester compound I*6 |
| Example 17 | Ester compound II*7 |
| Example 18 | Mineral Oil*8 |
| Comparative Example 1 | Polyoxypropylene glycol dimethyl ether*1 |

| | Carboxylic acid alkali metal salts | | Phosphates | |
|---|---|---|---|---|
| | Compound | Amount (% by weight) | Compound | Amount (% by weight) |
| Example 1 | Potassium oleate | 0.01 | — | — |
| Example 2 | Potassium oleate | 0.1 | — | — |
| Example 3 | Potassium oleate | 1 | — | — |
| Example 4 | Potassium oleate | 0.1 | TCP*9 | 1 |
| Example 5 | Potassium palmitate | 0.1 | — | — |
| Example 6 | Potassium palmitate | 0.1 | TCP*9 | 1 |
| Example 7 | Sodium oleate | 0.5 | TCP*9 | 1 |
| Example 8 | Potassium oleate | 0.2 | TCP*9 | 1 |
| Example 9 | Potassium oleate | 0.1 | — | — |
| Example 10 | Potassium oleate | 0.1 | TCP*9 | 1 |
| Example 11 | Potassium sebacate | 0.5 | TCP*9 | 1 |
| Example 12 | Potassium oleate | 0.1 | TOP*9 | 1 |
| Example 13 | Sodium oleate | 0.1 | TOP*9 | 1 |
| Example 14 | Potassium oleate | 0.1 | TCP*9 | 1 |
| Example 15 | Sodium oleate | 0.1 | TCP*9 | 1 |
| Example 16 | Potassium oleate | 0.1 | TCP*9 | 1 |
| Example 17 | Potassium oleate | 0.1 | TCP*9 | 1 |
| Example 18 | Lithium oleate | 0.1 | TCP*9 | 1 |
| Comparative | Chlorinated | 1.5 | — | — |

TABLE 1-continued

| | |
|---|---|
| Example 1 | paraffin |

*1number average molecular weight 1270
*2number average molecular weight 640
*3number average molecular weight 1300
*4number average molecular weight 1100
*5kinematic viscosity at 100° C.: 4.6 cSt
*6polyester of neopentyl glycol, adipic acid and 2-methylcaproic acid (90.5 cSt (40° C.))
*7hexaester of a mixed fatty acid consisting of isovaleric acid, n-hexanoic acid and dipentaerythritol (70.5 cSt (40° C.))
*8naphthenic mineral oil (5.0 cSt (100° C.))
*9tricresyl phosphate
*10trioctyl phosphate The refrigerating machine oil compositions obtained in said Examples 1 to 18 and Comparative Example 1 were assayed according to the following methods for measuring the wear resistance of aluminum-steel friction surfaces, the stability, the appearance and the two-layer separation temperature (the critical miscibility temperature at the elevated temperature region). The results are shown in Table 2.

(a) Wear resistance

The wear loss was measured using aluminum (A 4032) as a block and steel (SUJ-2) as a pin in the Falex wear test, under the conditions of a Flon 134a blow rate of 10 liter/hour, a load of 400 pounds, a testing hour of one hour, a revolution of 1200 rpm and an oil temperature of 80° C.

(b) Stability

The stability was evaluated by means of shield tube test. A 2:1 mixture of the sample oil and the refrigerant (Flon 134a) was sealed up in a glass tube, along with iron, copper and aluminum catalysts. After heating for 240 hours at 175° C., the oil and catalysts were observed for the appearance and whether or not a sludge was formed therein was checked.

(c) Appearance of the compositions

Thirty minutes after the mixture of the compositions was over, their appearance was observed to check whether or nor there is tarnish, deposit or the like therein.

(d) Two-layer separation temperature (Critical miscibility temperature at elevated temperature region)

A 1:9 (by weight) mixture of the sample oil and the refrigerant (Flon 134a) was sealed up in a pressure glass container having an internal volume of approximately 10 ml. The temperature was caused to rise gradually starting from a state where the mixture remained homogeneously dissolved, then the initial temperature of phase separation (two layer separation) of the sample oil from the refrigerant was measured and the two layer separation temperature was obtained.

TABLE 2

| | Performance | | | | | |
|---|---|---|---|---|---|---|
| | Wear resistance (mg) | Stability | | | Appearance of lubricant | Two-layer separation temperature (°C.) |
| | | Appearance | Catalyst | Sludge formation | | |
| Example 1 | 0.9 | good | good | none | good | over 60° C. |
| Example 2 | 0.7 | good | good | none | good | over 60° C. |
| Example 3 | 0.6 | good | good | none | good | over 60° C. |
| Example 4 | 0.3 | good | good | none | good | over 60° C. |
| Example 5 | 0.8 | good | good | none | good | over 60° C. |
| Example 6 | 0.3 | good | good | none | good | over 60° C. |
| Example 7 | 0.3 | good | good | none | good | over 60° C. |
| Example 8 | 0.3 | good | good | none | good | over 60° C. |
| Example 9 | 0.5 | good | good | none | good | over 60° C. |
| Example 10 | 0.2 | good | good | none | good | over 60° C. |
| Example 11 | 0.3 | good | good | none | good | over 60° C. |
| Example 12 | 0.3 | good | good | none | good | over 60° C. |
| Example 13 | 0.3 | good | good | none | good | over 60° C. |

TABLE 2-continued

| | Performance | | | | | |
|---|---|---|---|---|---|---|
| | Wear resistance (mg) | Stability | | | Appearance of lubricant | Two-layer separation temperature (°C.) |
| | | Appearance | Catalyst | Sludge formation | | |
| Example 14 | 0.1 | good | good | none | a little tarnished | below 50° C. |
| Example 15 | 0.1 | good | good | none | a little tarnished | below 50° C. |
| Example 16 | 1.5 | good | good | none | good | over 60° C. |
| Example 17 | 1.8 | good | good | none | good | over 60° C. |
| Example 18 | 0.1 | good | good | none | a little tarnished | below 50° C. |
| Comparative Example 1 | 28 | brown | color change* | present | good | over 60° C. |

*found to be corroded

What is claimed is:

1. A refrigerating machine oil composition for use in a refrigerating machine containing a hydrogen-containing fluorocarbon as a refrigerant which comprises a base oil that is at least one member selected from the group consisting of a polyoxyalkylene glycol derivative and a polyester compound and 0.001 to 10% by weight, based on the total of the composition, of an alkali metal salt of a fatty acid having from 12 to 30 carbon atoms or an alkali metal salt of a dicarboxylic acid having from 3 to 30 carbon atoms.

2. The refrigerating machine oil composition according to claim 1, wherein said base oil has a kinematic viscosity at 40° C. of 5 to 1000 cSt and a pour point of −10° C. or lower.

3. The refrigerating machine oil composition according to claim 1, wherein the hydrogen-containing fluorocarbon is 1,1,1,2-tetrafluoroethane.

4. The refrigerating machine oil composition according to claim 1, wherein the hydrogen-containing fluorocarbon is at least one member selected from 1,1,2,2-tetrafluoroethane, 1,1-dichloro-2,2,2-trifluoroethane, 1-chloro-1,1-difluoroethane, 1,1-difluoroethane, chlorodifluoromethane, 1,1,1,2-trifluoroethane and trifluoromethane.

5. A refrigerating machine composition for use in a refrigerating machine containing a hydrogen-containing fluorocarbon as a refrigerant which comprises a base oil that is at least one member selected from the group consisting of a polyoxyalkylene glycol derivative and a polyester compound and 0.001 to 10% by weight, based on the total of the composition of an alkali metal salt of palmitic acid, oleic acid or sebacic acid.

* * * * *